US006138959A

United States Patent [19]

Wydotis et al.

[11] Patent Number: 6,138,959

[45] Date of Patent: Oct. 31, 2000

[54] LOW PROFILE SWITCH MACHINE GEAR BOX

[75] Inventors: Leonard M. Wydotis, Seven Fields, Pa.; Marvin R. Wohlhueter, Lexington, S.C.; Kevin M. McQuistian, Export, Pa.

[73] Assignee: Union Switch & Signal, Inc., Pittsburgh, Pa.

[21] Appl. No.: 09/167,106

[22] Filed: Oct. 6, 1998

[51] Int. Cl.[7] ..... E01B 7/00

[52] U.S. Cl. ..... 246/406

[58] Field of Search ..... 246/218, 221, 246/240, 393, 405, 406, 407, 410; 192/48.91, 99 R, 99 A; 74/625, 661

[56] References Cited

U.S. PATENT DOCUMENTS

| | | | |
|---|---|---|---|
| 1,716,787 | 6/1929 | McWhirter | 246/406 |
| 1,796,323 | 3/1931 | Dalzell et al. | 246/406 |
| 1,889,022 | 11/1932 | Little | 246/406 |
| 5,494,242 | 2/1996 | Ludwick et al. | 246/393 |
| 5,669,587 | 9/1997 | Van Alstine et al. | 246/220 |

OTHER PUBLICATIONS

Service Manual No. 6263 for M–3, M23–A, M–23B Electric Switch Machines with Permanent Magnet Motor, Copyright 1992, Union Switch & Signal Inc.

*Primary Examiner*—Mark T. Le

*Attorney, Agent, or Firm*—David V. Radack; Kirk D. Houser; Eckert Seamans Cherin & Mellott, LLC

[57] ABSTRACT

A railroad switch machine gear box having a low vertical profile is provided, wherein a compound gear rotatably mounted within a housing along a first vertical axis cooperatively engages an adjacent main crank gear. The main crank gear is rotatably mounted within the housing about a main crank shaft that extends vertically within the gear box housing along a second vertical axis that is different than the first vertical axis. A bevel gear fixedly mounted to a hand throw shaft rotatably mounted within the housing along a first horizontal axis cooperatively engages the compound gear, thereby to rotate the compound gear when the hand throw shaft is rotated, typically with a hand throw lever affixed to the hand throw shaft external to the housing. The hand throw shaft may be rotatable about an eccentric shaft that is independently mounted and rotatable with the housing along the first horizontal axis. A motor/manual mode selector lever may be affixed to the eccentric shaft external to the gear box housing, thereby to rotate the eccentric shaft in a manner known in the art. Typically, rotation of the mode selector lever in a first direction selects a manual mode of gear box operation; rotation in the opposite direction selects a power mode of operation. A clutch yoke may be slidably mounted about a clutch cup assembly and the main crank shaft, and may be pivotable at a first end along a pivot pin positioned along a pivot axis that is parallel to the first horizontal axis, thereby to provide the advantage of simplifying movement of the hand throw lever and the mode selector lever from one side of the gear box to the other. The pivoting action of the eccentric shaft may be detected by a proximity sensor that senses a target associated with the second end of the clutch yoke.

12 Claims, 9 Drawing Sheets

LOW PROFILE SWITCH MACHINE GEAR BOX

CROSS REFERENCE TO RELATED APPLICATION

Reference is made to U.S. patent application Ser. No. 09/149,195, filed on Sep. 8, 1998, titled CAPTIVE POINT DETECTION SYSTEM WITH SINGLE SWITCH POSITION TARGET, and U.S. patent application Ser. No. 09/120,610 filed on Jul. 22, 1998, now U.S. Pat. No. 6,062,514 titled RAILWAY SWITCH CIRCUIT CONTROLLER, both applications of which relate to art similar to the present invention and are commonly owned by the applicant.

BACKGROUND OF THE INVENTION

1. Field of the Invention

The present invention relates generally to switch devices for switching the positions of railway tracks in order for trains to move from one track to another. More particularly, the present invention relates to a gear box having a low vertical profile, to be used in an electric motor driven switch machine.

2. Description of the Related Art

It is a requirement for operation of a railroad network to have the capability of switching railroad trains from one track to another. A common method of providing this switching capability is to install an electric motor driven switch machine alongside of, and interconnected to, a switch point of a railroad track. These switch machines often have one or more manual operations for shifting the position of the track without the use of the electric motor for certain situations, such as when electric power is not available.

Two manual operations typically integrated within switch machines are the hand crank and hand throw operations. The hand crank operation permits operational personnel to switch the track at the switch point by turning a hand crank for maintenance and installation purposes. The handthrow operation permits operational personnel to switch the track, i.e., throw the switch machine, at the switch machine when control signals from a remote control facility are not able to reach the switch machine.

Conventional design practice has been to place hand throw means for controlling the handthrow operation above one of the drive shafts of the switch machine, such as the crankshaft. This practice not only creates an undesirable bump in the top profile of the machine, but also contributes to the high vertical profile of existing machines. However, this practice does in fact provide a simpler gear box with fewer components than when the hand throw means is not located above one of the drive shafts, as in the related art low profile switch machine disclosed in U.S. Pat. No. 5,494,242, issued in the name of Ludwick et al. and further described below. A lower profile gear box mounted on a typical switch machine assembly thereby to provide a lower vertical profile and no projections extending from its top surface is desirable for many applications. Particularly for transit applications it is essential that a low profile be maintained by a switch machine in order to clear a railway car clearance profile identified by steps, third rail electric pickups, and other types of ground clearing equipment extending down from a transit car or locomotive.

A low profile switch machine without overhead projection is also desirable for additional safety and maintenance reasons. The switch machine is subject to all manner of damage due to its harsh environment. For example, vehicles or objects that may contact and damage the switch machine include rail maintenance equipment, snow removal means, foreign objects falling off trains, local car and truck traffic in the area and other objects passing through or over the general vicinity of the switch machine.

FIG. 1 shows a top view of a related art gear box 100 for a typical switch machine manufactured by Union Switch & Signal Inc. of Pittsburgh, Pa., USA. FIG. 2 is a cross-sectional right view of a switch machine gear box taken along the line II—II of FIG. 1. As is known in the art, a hand throw shaft 105 may be rotated approximately 180° by a hand throw lever 110 connected thereto. Similarly, an eccentric shaft 115 may be rotated approximately 180° independently of and within the hand throw shaft 105 (refer to FIG. 2) by a selector lever 120 connected thereto. The hand throw shaft 105 and the eccentric shaft 115 are commonly retained by a hand throw bearing 122 affixed to one side of a housing 123. Typically, a blind side bearing 124 is affixed to an opposing side of the housing 123 and pivotally retains a clutch yoke 125 at a pivot pin 126.

When the selector lever 120 is positioned to the right of the gear box 100, as shown in FIG. 1, the gear box 100 is known to be in "power" mode since the clutch yoke 125 (see FIG. 2) lowers a clutch cup assembly 127 to engage a worm gear 130, thereby to drive the switch machine by a motor (not shown) connected to reduction gears 132, 134, 136 typically located in a reduction box 138.

The selector lever 120 may be rotated 180° to the left of the gear box 100. When the selector lever 120 is positioned to the left of the gear box 100, the gear box 100 is known to be in "hand throw" mode since the clutch yoke 125 (see FIG. 2) raises the clutch cup assembly 127 to engage a top bearing bevel gear 145 that engages a large diameter hand throw bevel gear 147. When the gear box 100 is in hand position, rotation of the hand throw lever 110 rotates the hand throw bevel gear 147, and the hand throw bevel gear 147 rotates the top bearing bevel gear 145 and the clutch cup assembly 127, thereby to rotate a main crank shaft 150, thus operating "hand throw" mode of the gear box 100 in a manner known in the art. The large diameter hand throw bevel gear 147 typically requires the housing 123 to have a having a total working height H1, as shown in FIG. 2. The total working height H1 is typically in the range of about 9 inches.

FIG. 3 shows a partial cut-away side view of the clutch cup assembly 127, in accordance with the prior art. As is known in the art, the clutch cup assembly comprises an upper clutch 160, an upper clutch cup 164, a lower clutch 166, a lower clutch cup 170 and a clutch spring 172. The upper clutch 160 typically has a plurality of vertical teeth 162 and is slidably mounted about the main crank shaft 150 (see FIG. 2) along with the upper clutch cup 164 that cooperates with the upper clutch 160. Similarly, the lower clutch 166 typically has a plurality of vertical teeth 168 and is slidably mounted about the main crank shaft 150 (see FIG. 2) along with a lower clutch cup 170 that cooperates with the lower clutch 166. The clutch spring 172 typically is slidably mounted about the main crank shaft 150 and biases the upper clutch 162 and the upper clutch cup 164 away from the lower clutch 166 and the lower clutch cup 170. The clutch cup assembly 127 typically requires an assembly height H2, typically about 5.25 inches, and an assembly width W2, typically about 4.1875 inches. The assembly height H2 typically occupies a portion of the total working height H1.

Because a switch machine may be mounted on either the left hand or the right hand side of the track, the hand throw lever 110 and the selector lever 120 must be capable of being moved from one side of the gear box 100 to the other, thereby to accommodate a left side and a right side configuration. Commonly known gear box designs, such as the design of FIGS. 1–2, typically require that the entire gear box 100 be disassembled and then reassembled in order to accomplish the movement from one side of the gear box 100 to the other. As may be seen best by referring to FIGS. 1–2, conversion of the hand throw shaft 105 and the eccentric shaft 115 from the left side of FIG. 2 to the right side requires disassembly and then reassembly of at least the hand throw bearing 122, the blind side bearing 124, the hand throw shaft 105, the eccentric shaft 115, the clutch yoke 125, the pivot pin 126, the clutch cup assembly 127, the top bearing bevel gear 145, and the hand throw bevel gear 147. Typical conversion time may be greater than one hour and may require a wide variety of tool, including several open-end wrenches, screwdrivers, socket wrenches, pliers, etc.

Additionally, as viewed in FIG. 2, the total working height H1 of the gear box 100 commonly prevents the switch machine from being mounted close to the railroad tracks, and the machine mounting ties typically require cutting or dapping to lower the switch machine with respect to the top of the rail, thereby to stay below the car clearance line to avoid interference with moving railroad cars and equipment.

In the Ludwick reference, a switch machine for railroad tracks is provided having a low vertical profile without increasing the axial length of existing switch machines. Also, the capability of being operated by an electric motor, handcrank, or handthrow operation has been retained within the new dimensional constraints. A particular electric motor and gear box combination permits a low overall profile due to its compact size. The Ludwick reference describes that a worm gear shaft serves the dual purpose of driving a worm wheel and coupling to a handcrank, thus maintaining the low profile while increasing the functionality of the shaft. In addition a handthrow drive shaft is provided adjacent to a crank drive shaft in order to provide a handthrow operation while further maintaining the low profile of the switch machine. It is noted at Column 5, lines 37–42 of the Ludwick reference that the apparatus of the Ludwick reference provides a third vertical shaft, i.e., the hand throw shaft, that is separate and horizontally adjacent to the crank shaft, thereby to reduce the vertical profile of the switch machine by four or more inches lower than existing switch machines. However, the handthrow and selector levers are not easily moved from one side of the switch machine to another without time-consuming disassembly and reassembly of component parts.

Consequently, a need exists for a switch machine gear box having a low profile (i.e. height) that reduces the overall working height of the switch machine to permit the switch machine to be mounted closer to the rail but still remain below the railroad car clearance profiles, and wherein the handthrow and selector levers may be more easily moved from one side of the gear box to the other, thereby to accommodate mounting the switch machine on either the left-hand or the right-hand side of the track.

SUMMARY OF THE INVENTION

Accordingly, it is a primary object of the present invention to overcome the aforenoted problems associated with designing a switch machine gear box having a low vertical profile, thereby to reduce the overall vertical profile of the switch machine, while retaining all of the various capabilities of existing switch machines, including the electric motor, handcrank and handthrow operations.

It is a feature of the present invention to rotate the internal clutch cup assembly 90° about the main crank shaft compared to existing designs, thereby providing a clutch yoke pivot axis that is parallel to the eccentric shaft instead of being perpendicular to the eccentric shaft of the related art switch machines.

In accordance with the preferred embodiment of the present invention, a horizontal eccentric shaft is rotatably mounted internal to a gear box housing, positioned adjacent and substantially perpendicular to a main crank shaft that extends through the gear box housing along a first vertical axis. A hand throw shaft may be freely rotatable about an eccentric shaft along a first horizontal axis, and may be rotatable by a hand throw lever affixed to the hand throw shaft external to the gear box housing. A motor/manual mode selector lever may be affixed to the eccentric shaft external to the gear box housing, thereby to rotate the eccentric shaft in a manner known in the art. Rotation of the horizontal hand throw shaft rotates a bevel gear affixed thereto, which rotation of the bevel gear rotates a compound gear cooperatively engaged with the bevel gear and rotatably affixed to the housing along a second vertical axis. The compound gear may cooperatively engage an adjacent main crank gear that is rotatably mounted about the main crank shaft. A clutch yoke may be slidably mounted about a clutch cup assembly and the main crank shaft, and may be pivotable at a first end along a pivot pin positioned along a pivot axis that is parallel to the first horizontal axis. The main crank gear may cooperatively engage the clutch cup assembly that may engage the main crank shaft and disengage a worm gear when a second end of the clutch yoke is driven by rotation of the eccentric shaft when a hand throw (manual) mode is selected by the mode selector lever. Further, the main crank gear may cooperatively engage the clutch cup assembly that may disengage the main crank shaft and engage a worm gear when the clutch yoke is pivoted by rotation of the eccentric shaft when a power mode is selected by the mode selector lever. The pivoting action of the eccentric shaft may be detected by a proximity sensor that senses a target associated with the second end of the clutch yoke. Rotation of the mode selector lever 180° in one direction selects the power mode operation of the switch machine gear box and rotation of the motor/manual selector level 180° in the opposite direction selects the manual mode operation of the gear box.

Briefly described according to a preferred embodiment, a low vertical profile railroad switch machine gear box is provided having a mode selector for selecting among a plurality of modes, including a power mode and a hand throw mode, and a hand throw lever for operating the gear box in the hand throw mode, the gear box comprising: a crank shaft; a main crank gear freely rotatable about the crank shaft; a worm gear freely rotatable about the crank shaft; a clutch yoke slidably mounted about the crank shaft for engaging the main crank gear to the crank shaft; an eccentric shaft positioned adjacent and substantially perpendicular to the crank shaft, being rotatable by the mode selector in a first direction and a second direction that is opposite the first direction; a hand throw shaft freely rotatable about the eccentric shaft, being rotatable by the hand throw lever; a bevel gear fixedly mounted to the hand throw shaft, thereby to rotate therewith; a shifter mechanism having a first end that is pivotable and a second end that is drivable upwardly and downwardly, being cooperatively engaged with the clutch yoke; wherein, when the hand throw mode is selected by the mode selector, rotating the eccentric shaft in the first direction drives the second end upwardly to enable the hand throw mode by engaging the main crank gear and disengaging the worm gear, and, when the power mode is selected by the mode selector, rotating the eccentric shaft in the second direction drives the second end downwardly to enable the power mode by engaging the worm gear and disengaging the main crank gear.

An advantage of the present invention is that the hand throw lever and motor/manual mode selector lever may be moved from the left hand side of the gear box to the right hand side of the gear box, and vice versa, by removing a plurality of bolts on each side, transferring the hand throw/selector lever assembly to the opposite side, and rcsecuring the bolts previously removed without having to disassemble the clutch yoke pivot pin and other components internal to the housing.

Another advantage of the present invention is that conversion of the hand throw/selector levers from one side of the gear box to the other may require a single tool, preferably a ratchet with a 0.75 inch socket and extension, for instance.

Another advantage of the present invention is that the conversion process from one side of the gear box to the other may be accomplished in less than about ten (10) minutes and may be simple enough to be considered by railroad companies to be a "field" procedure rather than a "shop" procedure, thereby permitting the railroad companies to stock only one type of switch machine rather than being dependent on whether a right hand or left hand switch machine is in stock.

BRIEF DESCRIPTION OF THE DRAWINGS

The advantages and features of the present invention will become better understood with reference to the following more detailed description and claims taken in conjunction with the accompanying drawings, in which like elements are identified with like symbols and in which:

DESCRIPTION OF THE PREFERRED EMBODIMENTS

1. Detailed Description of the Figures

Figure 4:
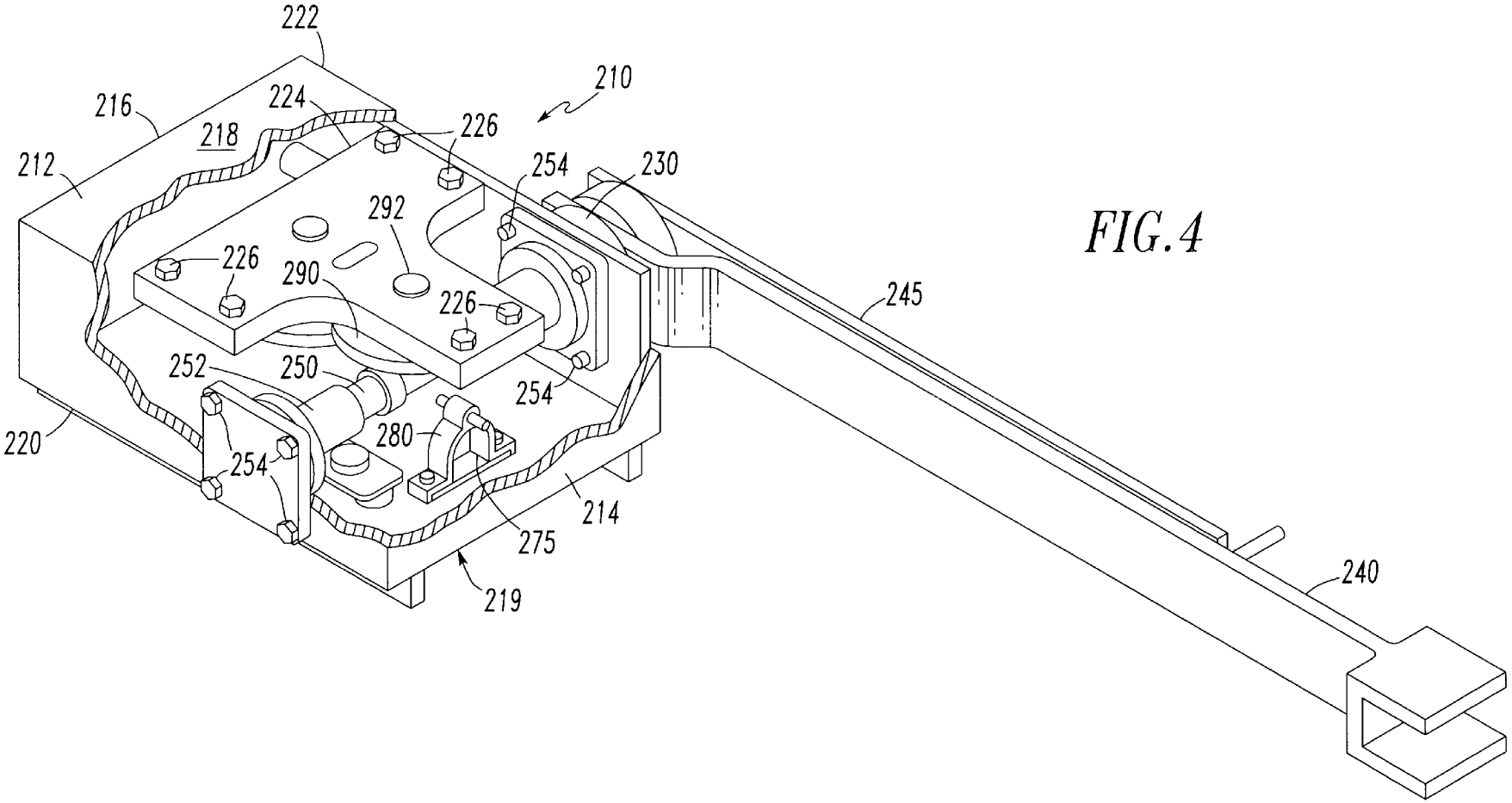
FIG. 4 is a perspective cut-away view showing inner components within the front, top and left sides of a preferred embodiment of the present invention.
Figure 5:
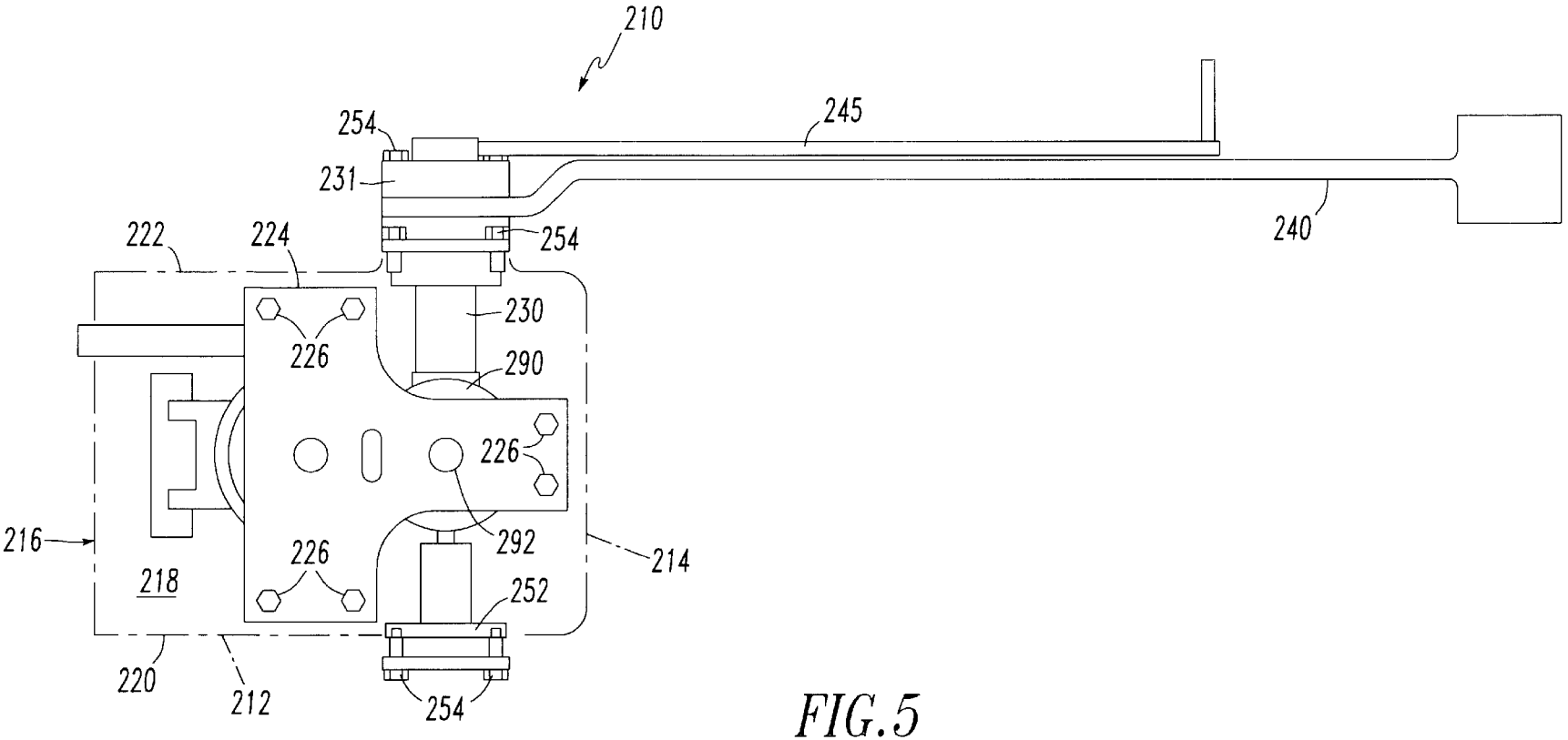
FIG. 5 is a top view of the preferred embodiment of FIG. 4.

Referring to the figures and, in particular, FIGS. 4–5, there is generally provided a gear box 210 of the present invention, having a low vertical profile, typically for use in an electric motor driven switch machine (not shown). FIG. 4 is a perspective partial-cut away view of the main components of the preferred embodiment, whereby a housing 212 has been partially cut away to show the main components therein. FIG. 5 is a top view of the preferred embodiment of FIG. 4, showing the housing 212 in phantom.

In a preferred embodiment, the housing 212 is generally a rectangular box having a front side 214, a rear side 216, a top side 218, a bottom side 219, a left side 220 and a right side 222. A top plate 224 may be affixed to the underside of the top side 218 with a plurality of fasteners 226, such as bolts, for instance. A hand throw bearing 230 may extend through the right side 222 and receive a hand throw shaft 235 rotatably mounted therein (refer to FIG. 9), which shaft may be rotated by a hand throw lever 240 affixed substantially perpendicularly to an end of the hand throw shaft 235 that extends outside the housing 212.

Figure 6:
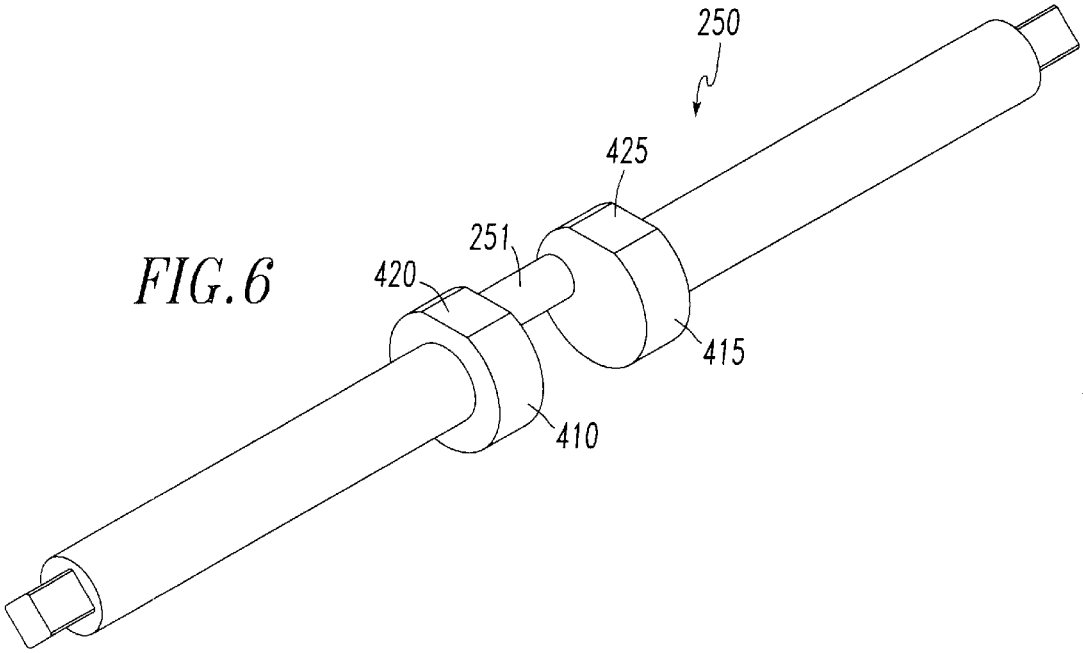
FIG. 6 shows an isometric view of the eccentric shaft in accordance with a preferred embodiment of the present invention.

FIG. 6 shows an isometric view of an eccentric shaft 250 in accordance with a preferred embodiment of the present invention. The eccentric shaft 250 having a central portion 251 (refer to FIG. 6) may extend through the hand throw shaft 235 and may be rotatably retained by a blind side bearing 252. In accordance with the preferred embodiment of FIG. 6, a hub 410 and a hub 415 may have a flat surface 420 and a flat surface 425, respectively machined therein for set screw rotational retention of the eccentric shaft 250 when the gear box 210 is being converted from a right to a left configuration, or vice versa.

Referring again to FIGS. 4 and 5, the blind side bearing 252 may be assembled into the left side 220 of the housing 212 and the hand throw bearing 230 may be assembled into the right side 222 of the housing 212. The bearings 230 and 252 may be affixed to the housing 212 with fasteners 254, such as bolts, for instance. The bearings 230 and 252 captivate the eccentric shaft 250, which shaft runs across the width of the housing 212. On the side of the hand throw lever 240, the eccentric shaft 250 is assembled through the center of the hand throw shaft 235, which shaft is rotatably retained by the hand throw bearing 230. The eccentric shaft 250 may be independently rotated within the hand throw shaft 235 by a motor/manual mode selector lever 245 affixed substantially perpendicularly to an end of the eccentric shaft 250 that extends outside the housing 212.

Figure 7:
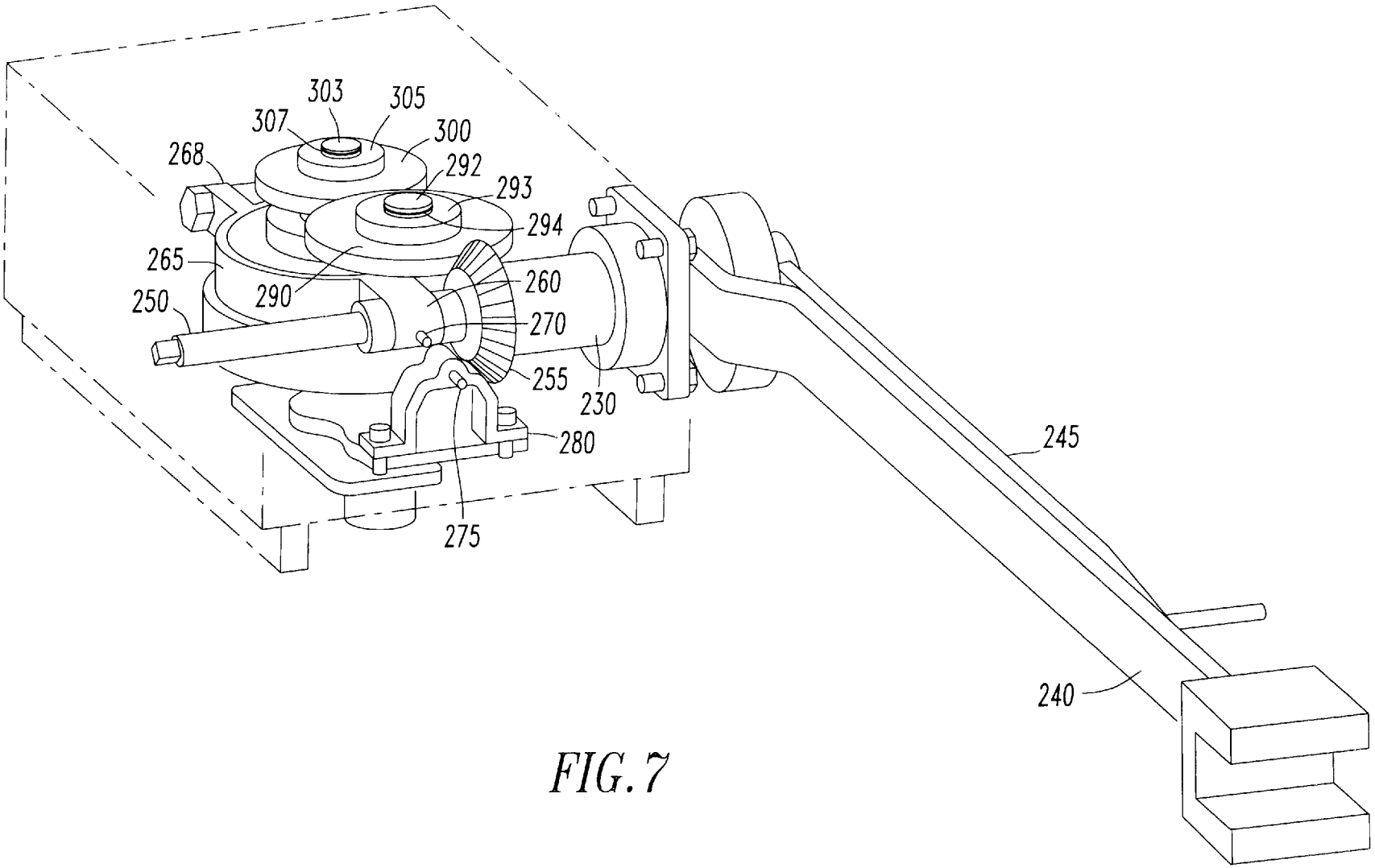
FIG. 7 is a perspective view of the preferred embodiment of FIG. 4 rotated slightly upwardly, wherein the housing is shown in phantom and the top plate and the blind side bearing has been omitted.

FIG. 7 is a perspective view of the preferred embodiment of FIG. 4 rotated slightly upwardly, wherein the housing 212 is shown in phantom and the top plate 224 and the blind side bearing 252 has been omitted. A bevel gear 255 may be fixedly mounted to the hand throw shaft 235 adjacent the hand throw bearing 230, thereby to rotate with rotation of the hand throw shaft 235. The bevel gear 255 may be keyed (with a commonly known gear shift key) on the external end, thereby to engage the hand throw lever 240. The hand throw lever 240 and the motor/manual selector lever 245 are assembled to the hand throw bearing 230 with a ball bearing assembly 231 (refer to FIG. 5), as known in the art. Rotation of the hand throw shaft 235 drives a drive end 260 of a clutch yoke 265 (refer to FIG. 8).

Figure 8:
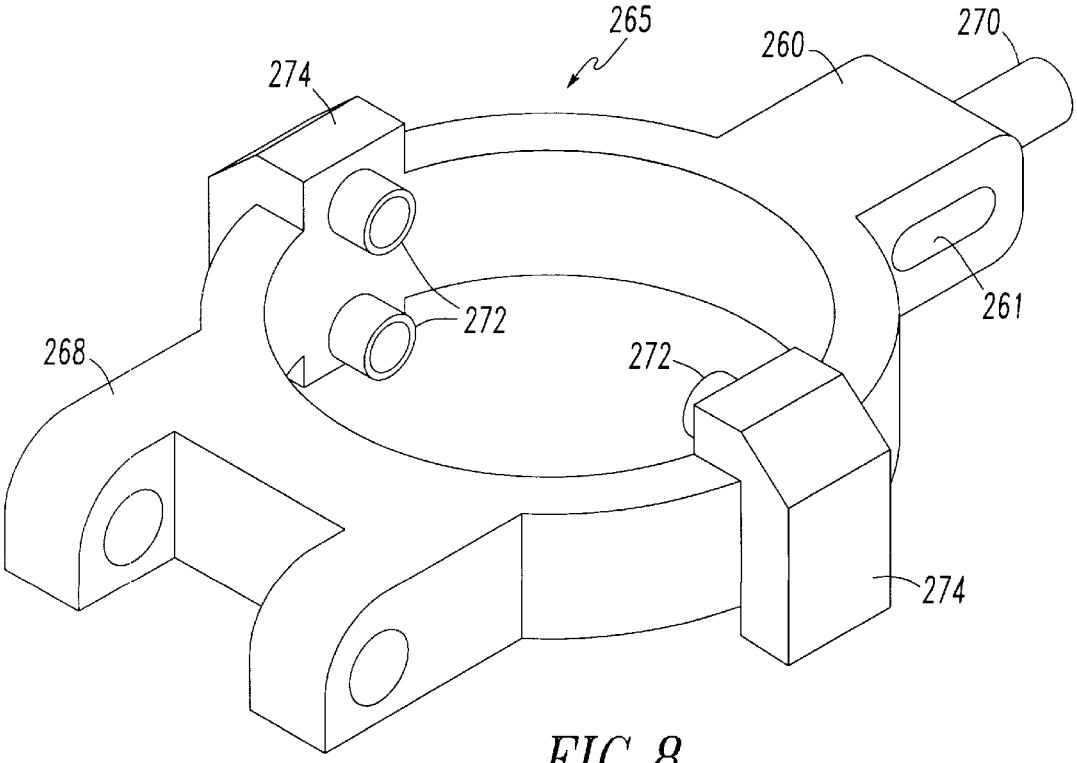
FIG. 8 is a perspective view of the clutch yoke in accordance with a preferred embodiment of the present invention.

FIG. 8 shows an isometric view of the clutch yoke 265 having a pivot end 268 and the drive end 260 defining a slot 261 in accordance with a preferred embodiment of the present invention. The slot 261 receives the central portion 251 of the eccentric shaft 250. In a preferred embodiment, the drive end 260 has a target 270 affixed thereto. Further, rollers 272 may be mounted to the clutch yoke 265 with brackets 274, as shown.

Referring back to FIG. 7, a sensing device 275 may be mounted with a bracket 280 in close proximity to the target 270, thereby to detect proximity of the target 270. In a preferred embodiment, an inductive proximity sensor may be used as the sensing device 275, in which case the target 270 would preferably be made of a ferrous metallic material.

A compound gear 290 having a lower bevel gear 291 (refer to FIG. 10) may be rotatably affixed to a shoulder bolt 292 that extends through a compound gear bearing 293 and through the top plate 224, and may be retained therein by a retaining ring 294. A main crank gear 300 may be rotatably affixed to a main crank 303 positioned adjacent the compound gear 290, so that the main crank gear 300 may cooperatively engage the compound gear 290. In a preferred embodiment, the main crank 303 may extend through a main crank gear bearing 305 and through the top plate 224. A retaining ring 307 may retain the main crank 303 within the top plate 224 (see FIG. 4). In a preferred embodiment, the eccentric shaft 250 is perpendicular to the main crank 303 and offset, such that the eccentric shaft 250 is not in the same centerline with the main crank 303.

Figure 9:
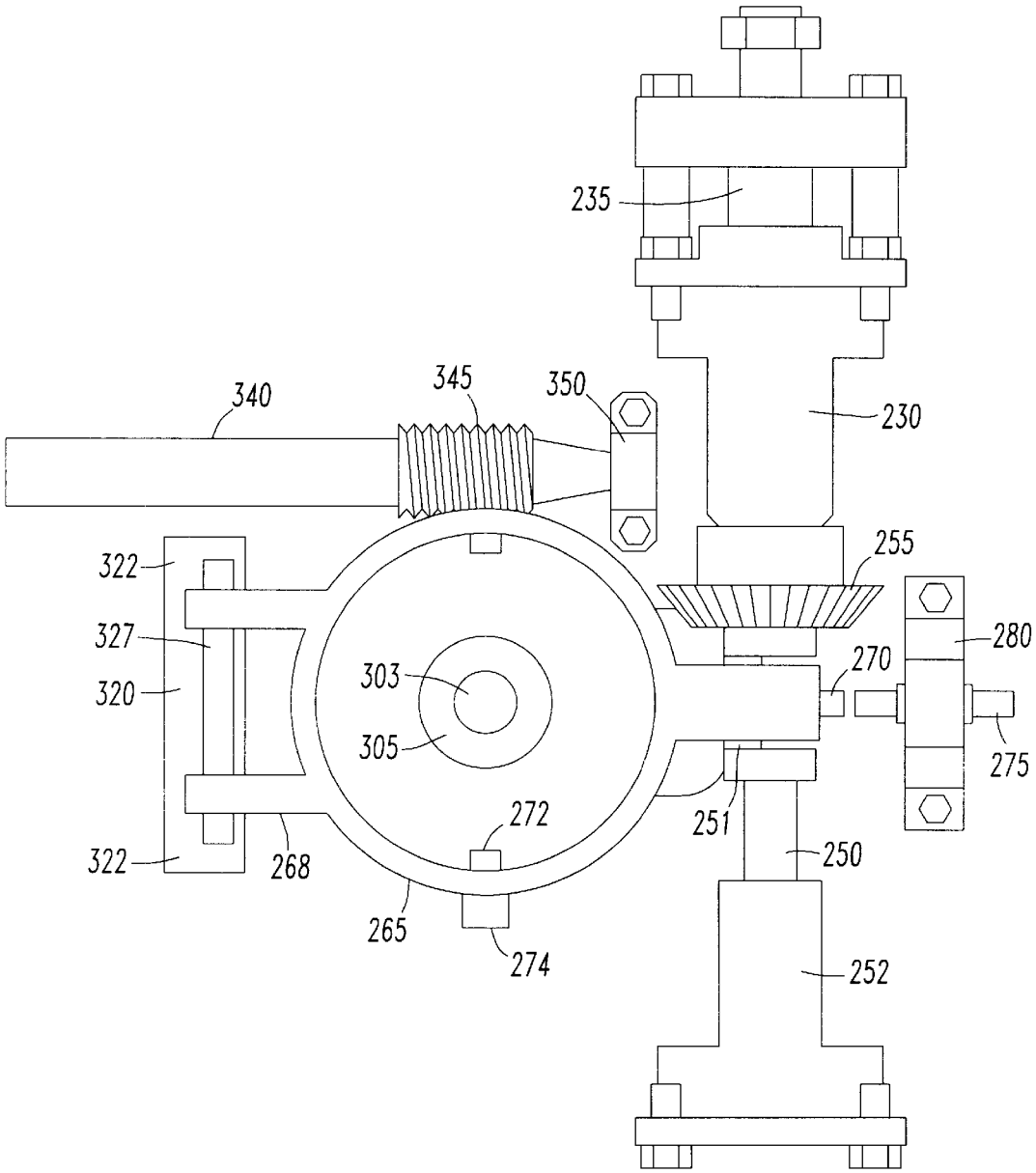
FIG. 9 is a close-up top view of the gear box of the preferred embodiment as shown in FIG. 5, wherein the handthrow arm, the motor arm, and the compound gear have been omitted.
Figure 10:
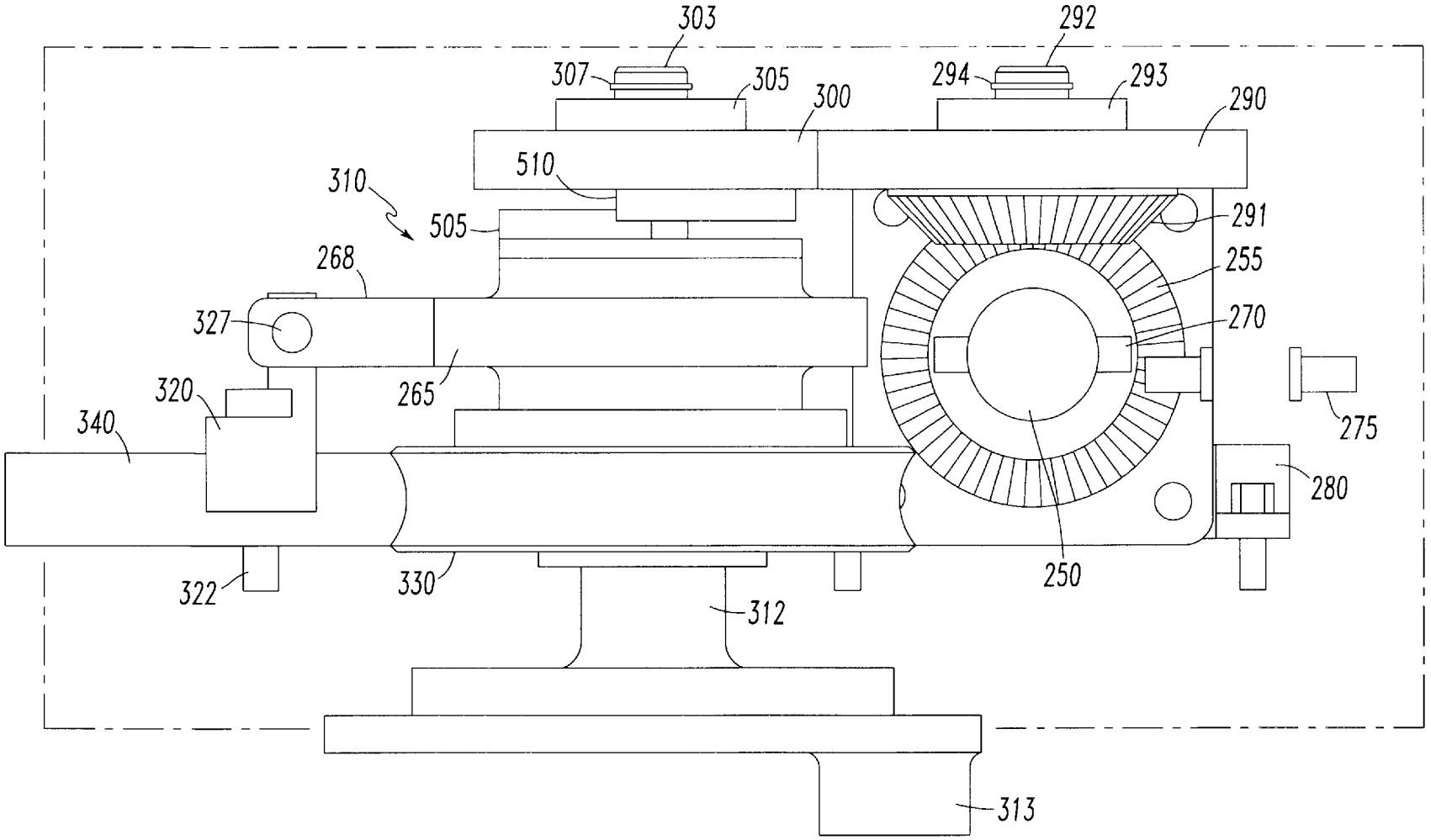
FIG. 10 is a close-up perspective view of the left side of the gear box of the preferred embodiment as shown in FIG. 4, wherein the top plate, the hand throw lever, the motor/manual selector lever, and the blind side bearing have been omitted, and the housing is shown in phantom.

FIG. 9 is a close-up top view of the gear box 210 of the preferred embodiment as shown in FIG. 5, wherein the housing 212, the top plate 224, the hand throw lever 240, the motor/manual mode selector lever 245, and the compound gear 290 have been omitted. FIG. 10 is a left side view of the gear box 210, wherein the housing 212, the top plate 224, the hand throw lever 240, and the motor/manual mode selector lever 245 have been omitted. Referring now to FIGS. 9–10, the main crank 303 may be affixed to the main crank base 312 and may have a lower hub 313 that operates within a commonly known lobe (not shown) in a commonly known operating bar (not shown). The main crank 303 may have splines (i.e. slots) which are commonly known in the art. A clutch cup assembly 310 is rotatably retained about the main crank 303 (see FIG. 11).

A pivot block 320 may be fixedly mounted with a fastener 322 to the bottom side 219 (see FIG. 4). The clutch yoke 265 may be pivotally mounted with a pivot pin 327 to the pivot block 320. A worm gear 330 may be rotatably mounted to the main crank 303 between the main crank base 312 and the clutch yoke 265. A worm shaft 340 having a worm shaft teeth 345 may extend through the rear side 216 and be rotatably retained by a pillow block 350.

Figure 1:
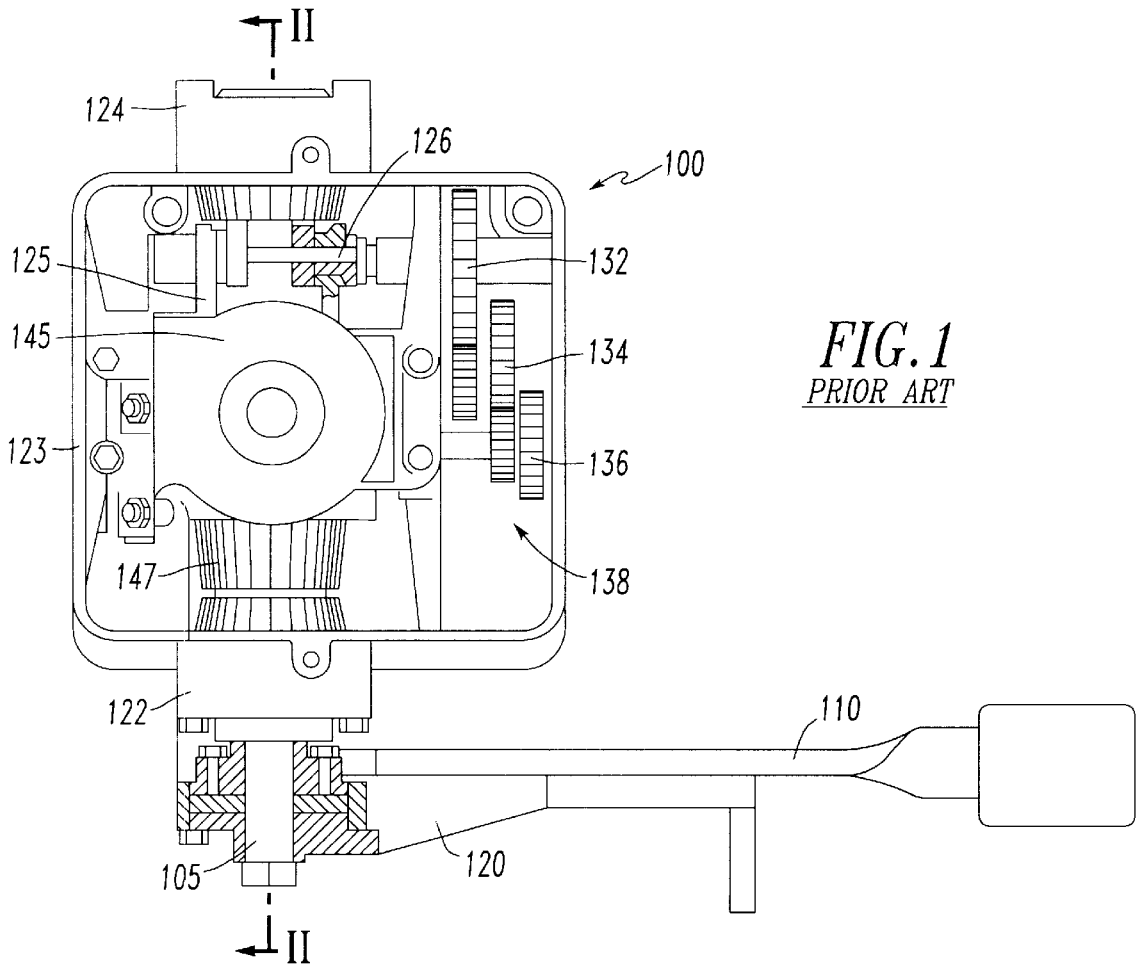
FIG. 1 PRIOR ART
FIG. 1 is a top view of a switch machine gear box in accordance with the prior art.
Figure 2:
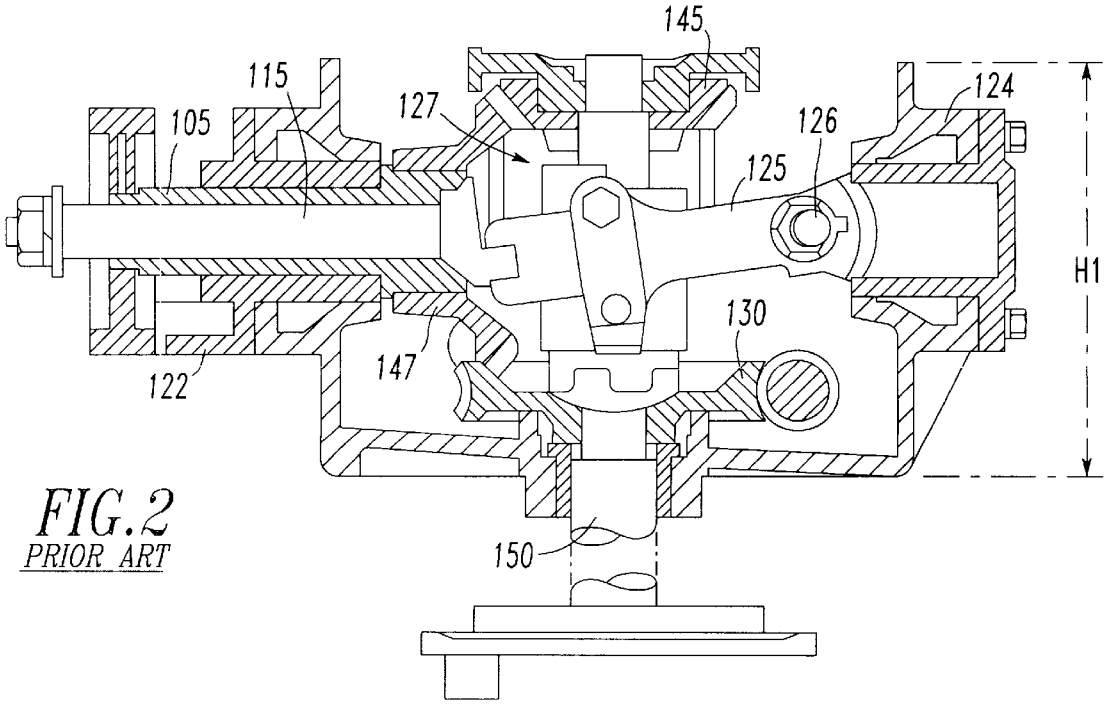
FIG. 2 PRIOR ART
FIG. 2 is a cross-sectional right view of a switch machine gear box taken along the line II—II of FIG. 1.
Figure 3:
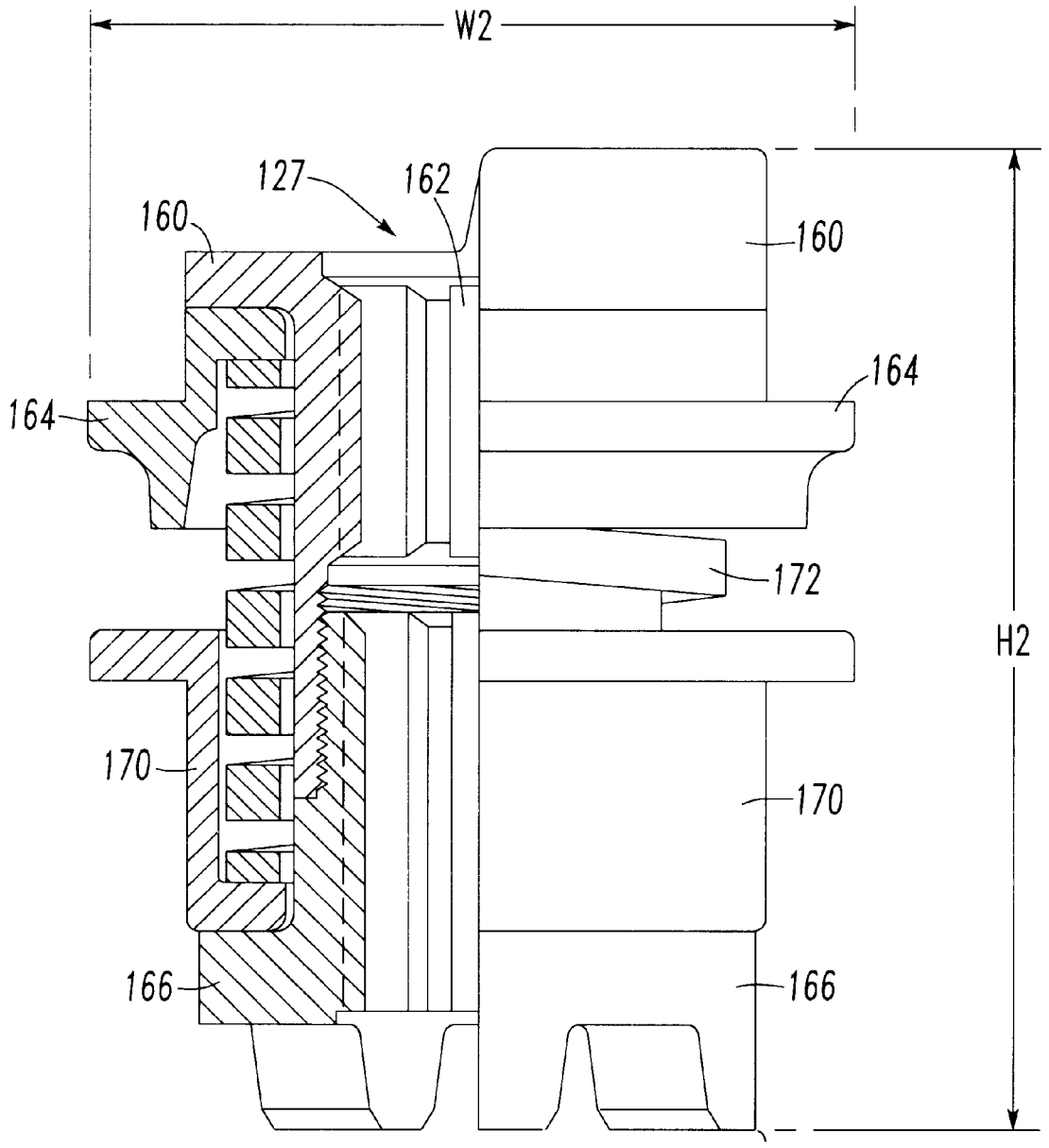
FIG. 3 PRIOR ART
FIG. 3 is a cross-sectional view of a clutch assembly in accordance with the prior art.
Figure 11:
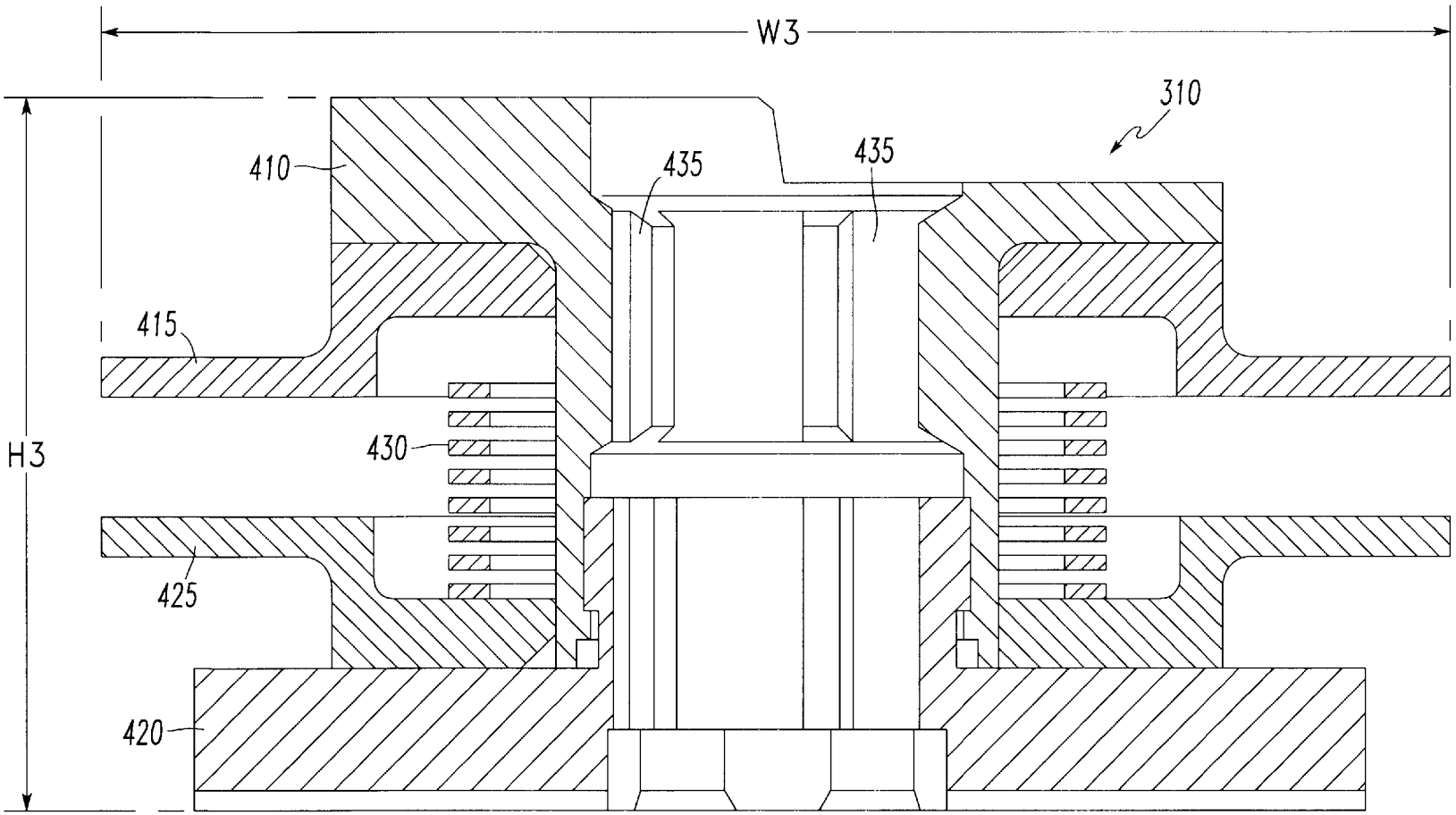
FIG. 11 is a cross-sectional view of the clutch cup assembly in accordance with a preferred embodiment of the present invention.

FIG. 11 is a cross-sectional view of the clutch cup assembly 310 having an upper clutch 410, an upper clutch cup 415, a lower clutch 420, a lower clutch cup 425, a clutch spring 430, and a plurality of vertical teeth 435 in accordance with a preferred embodiment of the present invention. One skilled in the art will recognize the redesign of the clutch cup assembly 127 of FIG. 3, thereby to provide a total working height H3 that is lower than the total working height H2 of the clutch cup assembly 127 of FIG. 3, while also providing a total working width W3 that is longer than the total working width W2 of the clutch cup assembly 127 of FIG. 3. The cross-sectional gear-tooth profile of the gears may be increased to improve the mechanical strength characteristics. In a preferred embodiment, the diameter of the clutch cup assembly 300 may be increased from a typical 4.1875 to 6.0625 inches. In addition, the height of the clutch cup assembly 300 may be reduced from a typical 5.25 inches to 3.125 inches in overall height, thereby contributing more than two inches to the profile reduction (refer to FIGS. 3 & 11).

Moreover, in accordance with a preferred embodiment of the present invention, a new design for the eccentric shaft 250 reduced the vertical stroke or movement of the internal clutch cup assembly 310. As a result, only 0.5 inch of vertical movement is required by the gearbox 210 of the present invention to engage and disengage the hand throw and motor gears. In contrast, commonly known gear boxes require 1.5 inches of vertical movement to engage and disengage the hand throw and motor gears. Further, a 9:11 gear ratio has been obtained in the gear box 210 of the present invention with the design of a hand throw gearing system that operates in a horizontal plane rather than the commonly known vertical plane. The hand throw lever 240 rotates 180° in the hand throw mode to drive the main crank 303 220°, thereby to drive the switch machine (not shown) from one position to the next.

2. Operation of the Preferred Embodiment

In operation, the primary function of the switch machine gear box 210 of the present invention is to drive the switch machine (not shown) from one position to another in two modes of operation, manual and electric power. As mentioned, the gearing mechanism is contained in the housing 212 and the switch machine is ultimately driven by the rotation of the main crank 303. The clutch cup assembly 310 operates vertically up and down the main crank 303 guided by the commonly known splines (i.e. slots) machined in the main crank 303 along the length of its center shaft diameter. The splines engage commonly known vertical teeth (not shown) in the clutch cup assembly 310. The clutch cup assembly 310 is operated by the clutch yoke 265, which yoke pivots on the pivot block 320 with the pivot pin 327, and is assembled with the main crank 303 inserted through the center of the clutch cup assembly 310. The clutch yoke 265 is raised and lowered vertically with the 180° rotation of the eccentric shaft 250, thereby raising and lowering the clutch cup assembly 310 along the length of the main crank 303. The manual or "hand" throw mode of the gear box 210 is obtained when the clutch cup assembly 310 is in the upper position. The "electric power" mode is obtained when the clutch cup assembly 310 is in the lower position, as shown in FIG. 10.

In describing the operation of the clutch cup assembly 310, the plurality (typically about five) of vertical teeth 435 may be machined in the upper clutch 410 and the lower clutch 420. The plurality of vertical teeth 435 may engage a plurality of splines vertically machined in the main crank 303, as known in the art, thereby to rotate the main crank 303 as the clutch cup assembly 310 rotates. The upper clutch 410 and the lower clutch 420 are threaded together with a female thread in the upper clutch 410 and a male thread in the lower clutch 420. The upper and lower clutches are assembled with the upper clutch cup 415, the lower clutch cup 425 and the clutch spring 430 in the center of the clutch cup assembly 310. The rollers 272 on the clutch yoke 265 may provide rotatable support of the upper clutch cup 415 above the clutch yoke 265 and may provide rotatable support of the clutch yoke 265 upon the lower clutch cup 425. When the clutch cup assembly 310 is raised along the main crank 303, with the 180° rotation of the eccentric shaft 250, a 180° cut 505 (see FIG. 10) on the upper clutch 410 interfaces with a 180° cut 510 (see FIG. 10) on the main crank gear 300. When the two 180° cuts mesh, the clutch cup assembly 310 engages the gearing associated with the hand throw or manual operation. When the clutch cup assembly 310 is lowered along the main crank 303 with the 180° rotation of the eccentric shaft 250, the plurality of vertical teeth in the lower clutch 425 cooperatively engage the worm gear 330 in a manner known in the art. When the teeth mesh, the worm gear 330 is engaged and the gear box 210 is known to be in the power mode.

If the clutch cup assembly 310 is raised and the 180° cut on the top of the upper clutch does not match the rotational position of the main crank gear 300, the clutch yoke 265 and the lower clutch cup 425 are still in the raised position and only the lower clutch cup 425 compresses the clutch spring 430. The spring compression forces the upper clutch 410 into the full vertical position once the main crank gear 300 has rotated enough to align the two 180° cuts 505, 510 to permit them to mesh properly. Similarly, if the clutch cup assembly 310 is lowered and the vertical teeth 435 on the lower portion of the lower clutch 420 do not match the rotational position of the teeth on the worm gear 330, the clutch yoke 265 and the upper clutch cup 415 are still in the lowered position and the upper clutch cup 415 compresses the clutch spring 430. The compression of the spring 430 forces the lower clutch 420 into the lower vertical position once teeth on the worm gear 330 has rotated enough to align and properly mesh with the vertical teeth 435 on the lower clutch 420 and the worm gear 330.

A square or broached hole in the hub portion of the motor/manual mode selector lever 245 interfaces with the square ends of the eccentric shaft 250. When the selector lever 245 is rotated 180°, it rotationally drives the eccentric shaft 250 a total of 180°, which in turn will raise or lower the clutch yoke 265. The eccentric central portion 251 of the eccentric shaft 250 engages the slot 261 in the drive end 260 of the clutch yoke 265. As the clutch yoke 265 is raised and lowered, it raises and lowers the clutch cup assembly 310 along the vertical length of the main crank 303, thereby placing the clutch cup assembly 310 into either the "hand" mode of operation when the clutch yoke 265 is in the raised position, or the "power" mode of operation when the clutch yoke 265 is in the lowered position.

Electric power operation is obtained when the motor/manual mode selector lever 245 is rotated properly to lower the clutch yoke 265 and the clutch cup assembly 310, thereby to engage the worm gear 330. Typically, a motor (not shown) will drive the worm shaft 340 through a gearing ratio that in turn rotates the worm gear 330. The engagement of the worm gear 330 with the clutch cup assembly 310 permits the rotation of the worm gear 330 to rotate the main crank 303 a total of 220°. The lower hub 313 on the lower portion of the main crank 303 typically may drive a commonly known operating bar (not shown), as an integral part of the switch machine (not shown), in a linear fashion to throw the railroad switch points (not shown).

When the hand throw lever 240 is rotated 180° in the "hand" mode, the hand throw shaft 235 rotates due to the keyed engagement to the hand throw lever 240. The bevel gear 250 fixedly mounted on the opposite end of the hand throw shaft 235 adjacent the hand throw bearing 230 inside the housing 212 then rotates, thereby driving the lower bevel gear 291 on the compound gear 290. As described, the compound gear 290 may be secured to the top plate 224 with the shoulder bolt 292, such as a shoulder bolt for instance. The retaining ring 294 may secure the shoulder bolt 292. Rotation of the compound gear 290, the top portion of which is a commonly known spur-type gear, rotates, thereby driving the main crank gear 300. If the main crank gear 300 is properly meshed with the clutch cup assembly 310, the clutch cup assembly 310 will rotate the main crank 300 and throw the switch machine to the opposite position, as known in the art.

The 9:11 gear ratio between the spur gear on top of the compound gear 290 and the main crank gear 300 permits the 180° rotation of the hand throw lever 240 to rotate the main crank 303 a total of 220°. The lower hub 313 on the portion of the main crank 303 typically drives a commonly known operating bar, as an integral part of the switch machine, in a linear fashion to throw the railroad switch points.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims that follow.

What is claimed is:

1. A low vertical profile railroad switch machine gear box having a mode selector for selecting among a plurality of modes, including a power mode and a hand throw mode, and a hand throw lever for operating the gear box in the hand throw mode, the gear box comprising:

a crank shaft;

a main crank gear freely rotatable about said crank shaft;

a worm gear freely rotatable about said crank shaft;

an eccentric shaft positioned adjacent and substantially perpendicular to said crank shaft, being rotatable in a horizontal axis by the mode selector in a first direction and a second direction that is opposite said first direction;

a hand throw shaft freely rotatable about said eccentric shaft, being rotatable by the hand throw lever;

a spring-loaded clutch assembly mechanism cooperatively engaged with said crank shaft, for rotating said crank shaft when engaged therewith, wherein said spring-loaded clutch assembly mechanism engages the power mode while disengaging the hand throw mode, and disengages the power mode while engaging the hand throw mode; and a shifter mechanism having a first end that is pivotable and a second end that is drivable upwardly and downwardly, being cooperatively engaged with said spring-loaded clutch assembly mechanism, said shifter mechanism having a pivot axis that is parallel to said horizontal axis;

wherein, when the hand throw mode is selected by the mode selector, rotating said eccentric shaft in said first direction drives said second end upwardly to enable said hand throw mode by engaging said main crank gear and disengaging said worm gear, and, when the power mode is selected by the mode selector, rotating said eccentric shaft in said second direction drives said second end downwardly to enable the power mode by engaging said worm gear and disengaging said main crank gear.

2. The low vertical profile railroad switch machine gear box according to claim 1, further comprising:

a target associated with said shifter mechanism; and sensing means for detecting said target.

3. The low vertical profile railroad switch machine gear box according to claim 2, wherein said sensing means is a proximity sensing device and said target is manufactured from a ferrous material.

4. The low vertical profile railroad switch machine gear box according to claim 1, further comprising:

a bevel gear fixedly mounted to said hand throw shaft, thereby to rotate therewith in a first rotational plane;

a compound gear cooperatively engaged with said main crank gear in a second rotational plane that is different than said first rotational plane, and cooperatively engaged with said bevel gear, thereby to rotate said main crank gear in said second rotational plane when said bevel gear is rotated in said first rotational plane.

5. A low vertical profile railroad switch machine gear box having a mode selector for selecting among power mode and a hand throw mode, and having a hand throw for operating the gear box in the hand throw mode, the gear box comprising:

a housing;

an eccentric shaft rotatably mounted along a first axis within said housing, being rotatable by the mode selector in a first direction and in a second direction that is opposite said first direction;

a hand throw shaft freely rotatable about said eccentric shaft, being rotatable by the hand throw lever in said first direction and said second direction;

a single crank shaft, vertically mounted within said housing and positioned adjacent and substantially perpendicular to said eccentric shaft;

a main crank gear freely rotatable about said single crank shaft;

a worm gear freely rotatable about said single crank shaft;

a spring-loaded clutch assembly mechanism cooperatively engaged with said single crank shaft, for rotating said single crank shaft when engaged therewith, wherein said spring-loaded clutch assembly mechanism engages the power mode while disengaging the hand throw mode, and disengages the power mode while engaging the hand throw mode;

a clutch yoke having a first end portion, a central portion, and a second end portion, wherein said first end portion is pivotable in a pivot axis that is parallel to said first axis, wherein said second end portion is cooperatively engaged with said eccentric shaft to be driven upwardly when said eccentric shaft is rotated in said first direction and to be driven downwardly when said eccentric shaft is rotated in said second direction, and wherein said central portion is slidably mounted about said single crank shaft and said spring-loaded clutch assembly mechanism, thereby to engage said main crank gear to said single crank shaft in the hand throw mode and to engage said worm gear to said single crank shaft in the power mode; and wherein, when the hand throw mode is selected by the mode selector, rotating said eccentric shaft in said first direction drives said second end upwardly to enable said hand throw mode by engaging said main crank gear with said single crank shaft and disengaging said worm gear from said single crank shaft, and, when the power mode is selected by the mode selector, rotating said eccentric shaft in said second direction drives said second end downwardly to enable the power mode by engaging said worm gear with said single crank shaft and disengaging said main crank gear from said single crank shaft.

6. The low vertical profile railroad switch machine gear box according to claim 5, further comprising:

a target associated with said second end portion; and sensing means for detecting said target.

7. The low vertical profile railroad switch machine gear box according to claim 6, wherein said sensing means is a proximity sensing device and said target is manufactured from a ferrous material.

8. The low vertical profile railroad switch machine gear box according to claim 5, further comprising:

a bevel gear fixedly mounted to said hand throw shaft, thereby to rotate therewith in a first rotational plane;

a compound gear rotatably mounted to said housing, being cooperatively engaged with said main crank gear in a second rotational plane that is different than said first rotational plane, and being cooperatively engaged with said bevel gear, thereby to rotate said main crank gear in said second rotational plane when said bevel gear is rotated in said first rotational plane.

9. A low vertical profile railroad switch machine gear box comprising:

a housing;

an eccentric shaft rotatably mounted along a horizontal axis within said housing, being rotatable in a first direction and in a second direction that is opposite said first direction;

a hand throw shaft freely rotatable about said eccentric shaft, being rotatable in said first direction and said second direction;

a single crank shaft, vertically mounted within said housing and positioned adjacent and substantially perpendicular to said eccentric shaft;

a main crank gear freely rotatable about said single crank shaft;

a worm gear freely rotatable about said single crank shaft;

a spring-loaded clutch assembly mechanism cooperatively engaged with said single crank shaft, for rotating said single crank shaft when engaged therewith, wherein said spring-loaded clutch assembly mechanism engages a first operating mode while disengaging a second operating mode, and disengages said first operating mode while engaging said second operating mode;

a clutch yoke having a first end portion, a central portion, and a second end portion, wherein said first end portion is pivotable in a pivot axis that is parallel to said horizontal axis, wherein said second end portion is cooperatively engaged with said eccentric shaft to be driven upwardly when said eccentric shaft is rotated in said first direction and to be driven downwardly when said eccentric shaft is rotated in said second direction, and wherein said central portion is slidably mounted about said single crank shaft and said spring-loaded clutch assembly mechanism, thereby to engage said main crank gear to said single crank shaft in said second operating mode and to engage said worm gear to said single crank shaft in said first operating mode; and wherein, when said spring-loaded clutch assembly mechanism has engaged said second operating mode, rotating said eccentric shaft in said first direction drives said second end upwardly to enable said second operating mode by engaging said main crank gear with said single crank shaft and disengaging said worm gear from said single crank shaft, and, when said spring-loaded clutch assembly mechanism has engaged said first operating mode, rotating said eccentric shaft in said second direction drives said second end downwardly to enable said first operating mode by engaging said worm gear with said single crank shaft and disengaging said main crank gear from said single crank shaft.

10. The low vertical profile railroad switch machine gear box according to claim 9, further comprising:

a target associated with said second end portion; and sensing means for detecting said target.

11. The low vertical profile railroad switch machine gear box according to claim 10, wherein said sensing means is a proximity sensing device and said target is manufactured from a ferrous material.

12. The low vertical profile railroad switch machine gear box according to claim 9, further comprising:

a bevel gear fixedly mounted to said hand throw shaft, thereby to rotate therewith in a first rotational plane;

a compound gear rotatably mounted to said housing, being cooperatively engaged with said main crank gear in a second rotational plane that is different than said first rotational plane, and being cooperatively engaged with said bevel gear, thereby to rotate said main crank gear in said second rotational plane when said bevel gear is rotated in said first rotational plane.

* * * * *